US008827257B2

(12) United States Patent
Wang et al.

(10) Patent No.: US 8,827,257 B2
(45) Date of Patent: Sep. 9, 2014

(54) SHEET PROCESSING DEVICE

(75) Inventors: Chung-Kai Wang, Taipei (TW); Wen-Lung Hung, Taipei (TW); Chung-Jung Chiu, Taipei (TW)

(73) Assignee: Primax Electronics Ltd., Taipei (TW)

( * ) Notice: Subject to any disclaimer, the term of this patent is extended or adjusted under 35 U.S.C. 154(b) by 8 days.

(21) Appl. No.: 13/493,351

(22) Filed: Jun. 11, 2012

(65) Prior Publication Data

US 2013/0249160 A1 Sep. 26, 2013

(30) Foreign Application Priority Data

Mar. 23, 2012 (TW) ..... 101110097 A

(51) Int. Cl.
*B65H 31/26* (2006.01)
*B65H 37/04* (2006.01)
*G03G 15/00* (2006.01)

(52) U.S. Cl.
CPC ..... *B65H 31/26* (2013.01); *B65H 37/04* (2013.01); *G03G 15/00* (2013.01); *B65H 2404/65* (2013.01)
USPC ..... 270/58.12; 270/58.07; 270/58.08; 270/58.11; 270/58.17; 270/58.27

(58) Field of Classification Search
USPC ..... 270/37, 58.07, 58.08, 58.11, 58.12, 270/58.17, 58.27
See application file for complete search history.

(56) References Cited

U.S. PATENT DOCUMENTS

| | | | | |
|---|---|---|---|---|
| 6,634,641 | B2 * | 10/2003 | Yamakawa et al. | 271/220 |
| 6,997,451 | B2 * | 2/2006 | Yoshimura et al. | 270/58.12 |
| 7,461,837 | B2 * | 12/2008 | Saito et al. | 270/58.07 |
| 7,607,659 | B2 * | 10/2009 | Fukatsu et al. | 271/220 |
| 7,862,026 | B2 * | 1/2011 | Terao et al. | 270/58.12 |
| 7,871,066 | B2 * | 1/2011 | Kodama et al. | 270/58.12 |

* cited by examiner

*Primary Examiner* — Leslie A Nicholson, III
(74) *Attorney, Agent, or Firm* — Kirton McConkie; Evan R. Witt

(57) ABSTRACT

A sheet processing device includes a supporting plate, a stapler, a casing, a protrusion structure, and a swinging arm. The casing is disposed over the supporting plate. A sheet conveying channel is formed between the supporting plate and the casing. The protrusion structure is disposed on a lower surface of the casing, located beside the stapler and accommodated within the sheet conveying channel. During the process of introducing a sheet into the supporting plate, the stapled side of the sheet is flattened by the protrusion structure, and thus the possibility of upturning the sheet is minimized. During the process of introducing the plural sheets to the stapler, the stapled sides of the plural sheets are flattened by the protrusion structure, and thus the formation of the folded corners of the sheets is avoided.

8 Claims, 7 Drawing Sheets

SHEET PROCESSING DEVICE

FIELD OF THE INVENTION

The present invention relates to a sheet processing device, and more particularly to a sheet processing device with a function of flattening sheets.

BACKGROUND OF THE INVENTION

For stapling sheets in a labor-saving manner, the office machine is usually equipped with a sheet processing device for facilitating automatically stapling sheets. Generally, the sheet processing device is located in the vicinity of the sheet discharge tray of the office machine. When plural sheets have been printed or scanned and ejected to the sheet discharge tray, the edges of these sheets are aligned with each other by the sheet processing device. After the office machine has performed the printing or scanning tasks, the aligned sheets are transferred to a stapler. By the stapler, these sheets are jointed together. In such way, the labor cost is reduced, and the working efficiency is enhanced.

FIG. 1 is a schematic view illustrating a conventional sheet processing device. As shown in FIG. 1, the conventional sheet processing device 10 comprises a supporting plate 11, a paperweight 12, an edge alignment element 13, and a stapler guide 14. The supporting plate 11 is used for supporting plural papers 15. The stapler guide 14 is located at a side of the supporting plate 11. In addition, the stapler guide 14 has a slant surface 141 and an entrance 142.

After the plural sheets 15 are introduced into the supporting plate 11, the paperweight 12 is firstly moved downwardly in a direction A to flatten plural sheets 15, and then the paperweight 12 is moved upwardly in a direction B to be returned to the original position. After the flattening action of the paperweight 12 is completed, the edge alignment element 13 is moved in a direction C to push the plural sheets 15. Consequently, the edges of the plural sheets 15 are aligned with each other, and the curled portions 151 of the plural sheets 15 are gradually moved toward the stapler guide 14 to be contacted with the slant surface 141 of the stapler guide 14. As shown in FIG. 1, because of the slant surface 141, the entrance 142 has an externally-wide and internally-narrow profile. When the plural sheets 15 are introduced into the entrance 142 of the stapler guide 14, the curled portions 151 are suppressed by the slant surfaces 141, so that the curled portions 151 are further flattened. In such way, the plural sheets 15 can be smoothly introduced into the stapler guide 14 and stapled by the stapler guide 14. By the conventional sheet processing device 10, the possibility of upturning the curled portions 151 of the plural sheets 15 will be minimized, and thus the plural sheets 15 can be easily stapled.

However, since the curled portions 151 of the plural sheets 15 are suppressed by the slant surface 141 of the stapler guide 14 of the conventional sheet processing device 10 in order to smoothly stapled, some drawbacks may occur. For example, when the plural sheets 15 are moved toward the stapler guide 14 in the direction C, the curled portions 151 of the plural sheets 15 are possibly bent by the slant surface 141. Under this circumstance, the corners of the plural sheets 15 are possibly folded. That is, even if the plural sheets 15 can be smoothly stapled, the plural sheets 15 are suffered from unrecoverable damage.

SUMMARY OF THE INVENTION

The present invention provides sheet processing device for minimizing the formation of folded corners of the sheets.

In accordance with an aspect of the present invention, there is provided a sheet processing device for stapling plural sheets from a printing apparatus. The sheet processing device includes a supporting plate, a stapler, a casing, a protrusion structure, and a swinging arm. The supporting plate is used for supporting the plural sheets. The stapler is located at a side of the supporting plate for stapling the plural sheets. The casing is disposed over the supporting plate, wherein a sheet conveying channel is formed between the supporting plate and the casing. The protrusion structure is disposed on a lower surface of the casing, located beside the stapler and accommodated within the sheet conveying channel for flattening corresponding stapled sides of the plural sheets. The swinging arm is pivotally coupled with the casing and rotatable relative to the casing. The swinging arm has a bent part, which is disposed within the sheet conveying channel for flattening the plural sheets.

In an embodiment, the protrusion structure has a slant surface for facilitating flattening the stapled sides of the plural sheets.

In an embodiment, the protrusion structure includes a contact part, which is parallel with the sheet conveying channel.

In an embodiment, the bent part of the swinging arm is perpendicular to the sheet conveying channel.

In an embodiment, there is an angle between the bent part of the swinging arm and the feeding direction, and the angle is larger than 45 degrees and smaller than 90 degrees.

In an embodiment, the casing further includes a position-limiting structure for limiting an ascended attitude of the swinging arm.

In an embodiment, the sheet processing device further includes a first sheet alignment mechanism and a second sheet alignment mechanism. The first sheet alignment mechanism is disposed on the casing and accommodated within the sheet conveying channel for moving a topmost sheet of the plural sheets in a reverse feeding direction, thereby aligning first edges of the plural sheets with each other. The second sheet alignment mechanism includes a benchmark piece and a pushing piece. The benchmark piece and the pushing piece are respectively located at two opposite sides of the sheet conveying channel. When the pushing piece is moved relative to the benchmark piece to allow the topmost sheet to be contacted with the benchmark piece, second edges of the plural sheets are aligned with each other.

In an embodiment, the first sheet alignment mechanism includes a shaft and a paddling part, wherein the paddling part is fixed on the shaft for moving the topmost sheet in the reverse feeding direction.

In an embodiment, the paddling part includes one or more arc-shaped rubbery paddles.

In an embodiment, the first edge of the plural sheets is shorter than the second edge of the plural sheets.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
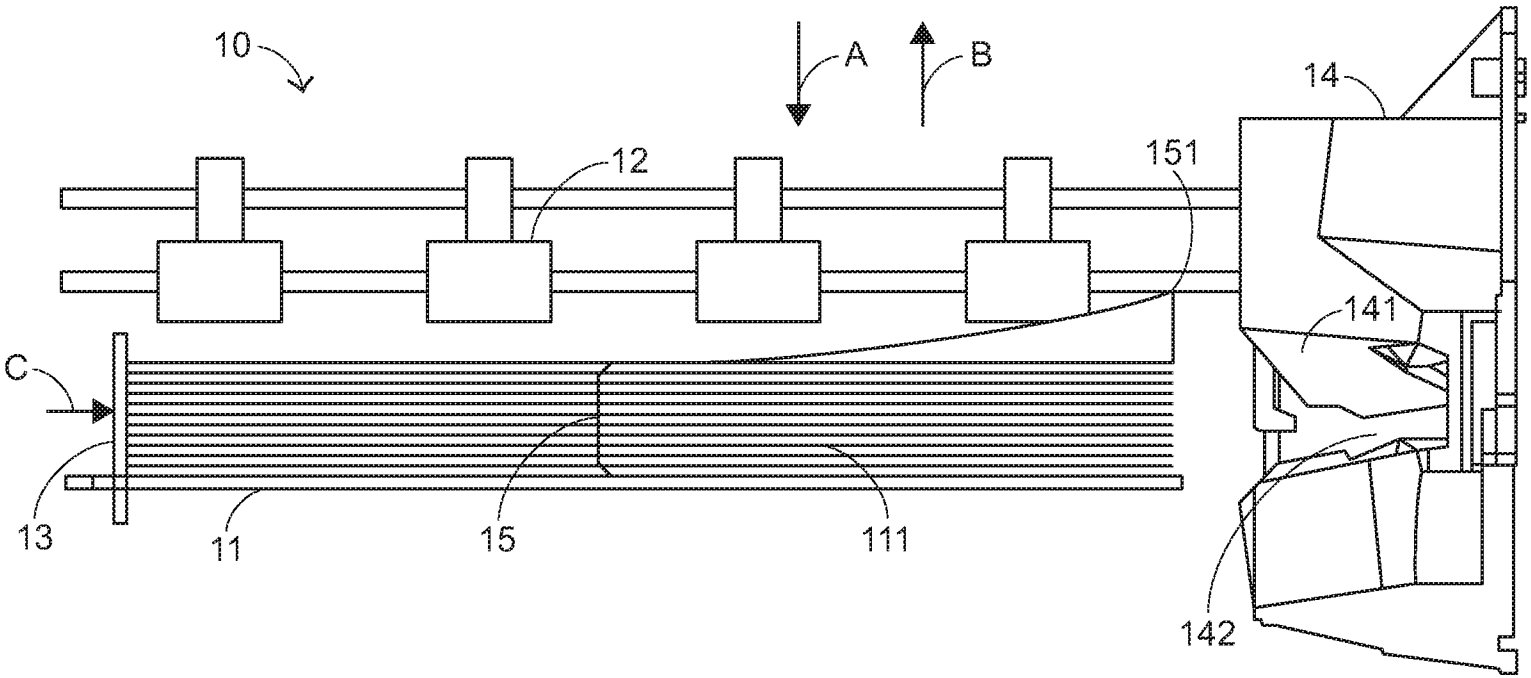
FIG.1 PRIOR ART
FIG. 1 is a schematic view illustrating a conventional sheet processing device.
Figure 2:
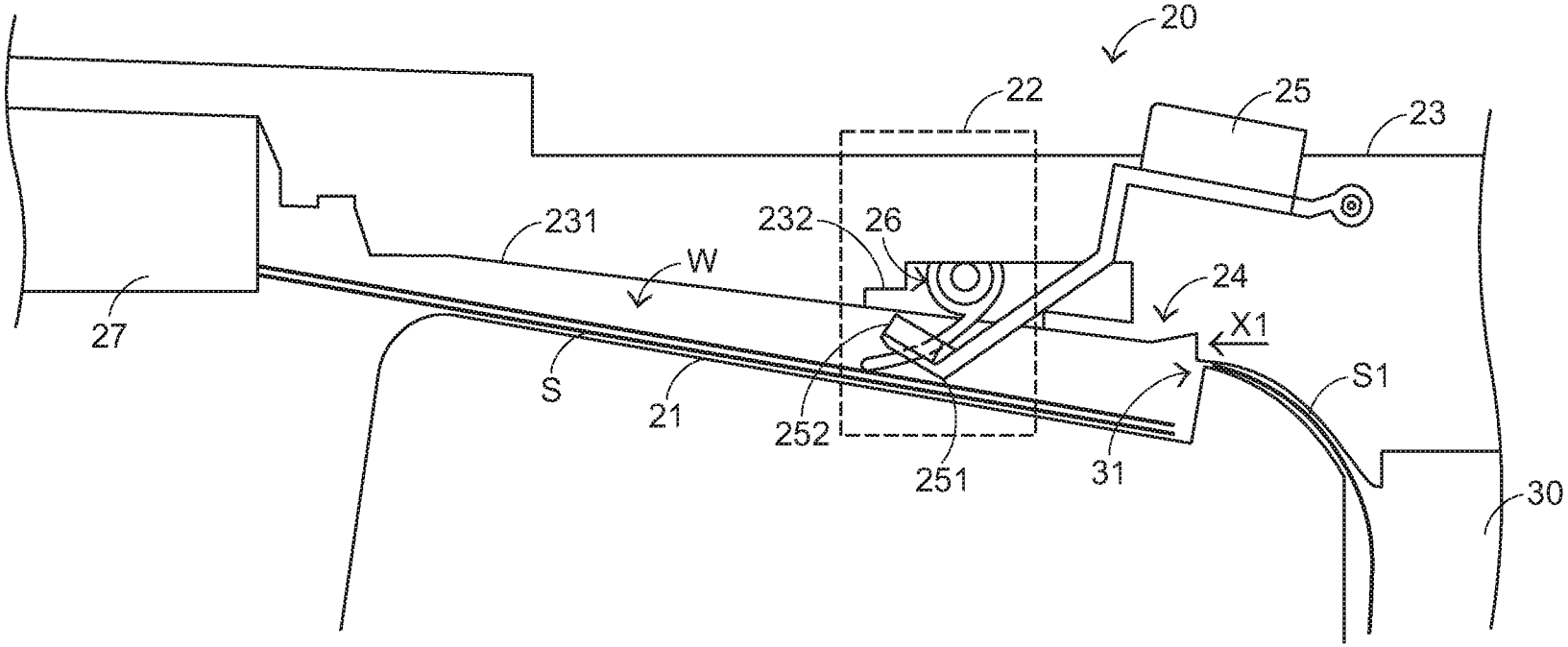
FIG. 2 is a schematic view illustrating a sheet processing device for use in a printing apparatus according to an embodiment of the present invention.

FIG. 2 is a schematic view illustrating a sheet processing device for use in a printing apparatus according to an embodiment of the present invention. As shown in FIG. 2, the sheet processing device 20 is located at an outlet 31 of the printing apparatus 30. The sheet processing device 20 is used for stapling plural sheets S that are ejected from the printing apparatus 30.

The sheet processing device 20 comprises a supporting plate 21, a stapler 22, a casing 23, a protrusion structure 24, a swinging arm 25, a first sheet alignment mechanism 26, a second sheet alignment mechanism 27, and a sheet conveying channel W. The casing 23 comprises a lower surface 231 and a position-limiting structure 232. The swinging arm 25 comprises a bent part 251 and a terminal part 252.

Figure 3:
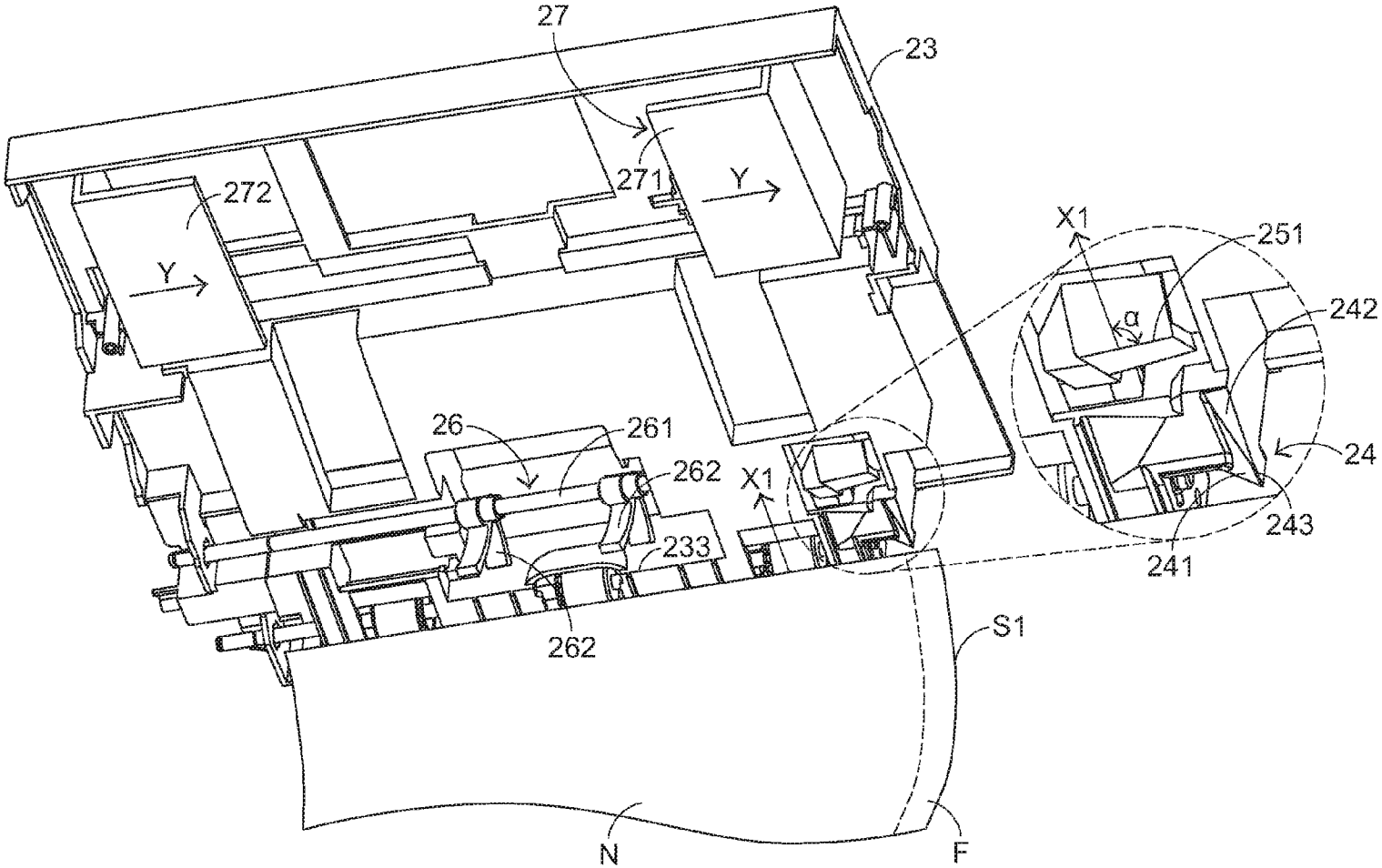
FIG. 3 is a schematic bottom view illustrating the sheet processing device according to an embodiment of the present invention.

FIG. 3 is a schematic bottom view illustrating the sheet processing device according to an embodiment of the present invention. As shown in FIG. 3, the casing 23 further has an alignment side 233. The protrusion structure 24 comprises a slant surface 241, a contact part 242, and a rim 243. The first sheet alignment mechanism 26 comprises a shaft 261 and a paddling part 262. The second sheet alignment mechanism 27 comprises a benchmark piece 271 and a pushing piece 272.

The locations and configurations of the components of the sheet processing device 20 will be illustrated in more details as follows.

As shown in FIG. 2, the supporting plate 21 is located at an outlet 31 of the printing apparatus 30 for supporting the plural sheets S that are outputted from the printing apparatus 30. The swinging arm 25 is pivotally coupled with the casing 23 and rotatable relative to the casing 23. The bent part 251 of the swinging arm 25 is disposed within the sheet conveying channel W. The casing 23 is disposed over the supporting plate 21. The sheet conveying channel W is formed between the casing 23 and the supporting plate 21. The sheet conveying channel W is used for allowing the plural sheets S to go through. Consequently, each sheet outputted from the outlet 31 of the printing apparatus 30 is transmitted to the supporting plate 21 through the sheet conveying channel W.

Figure 6:
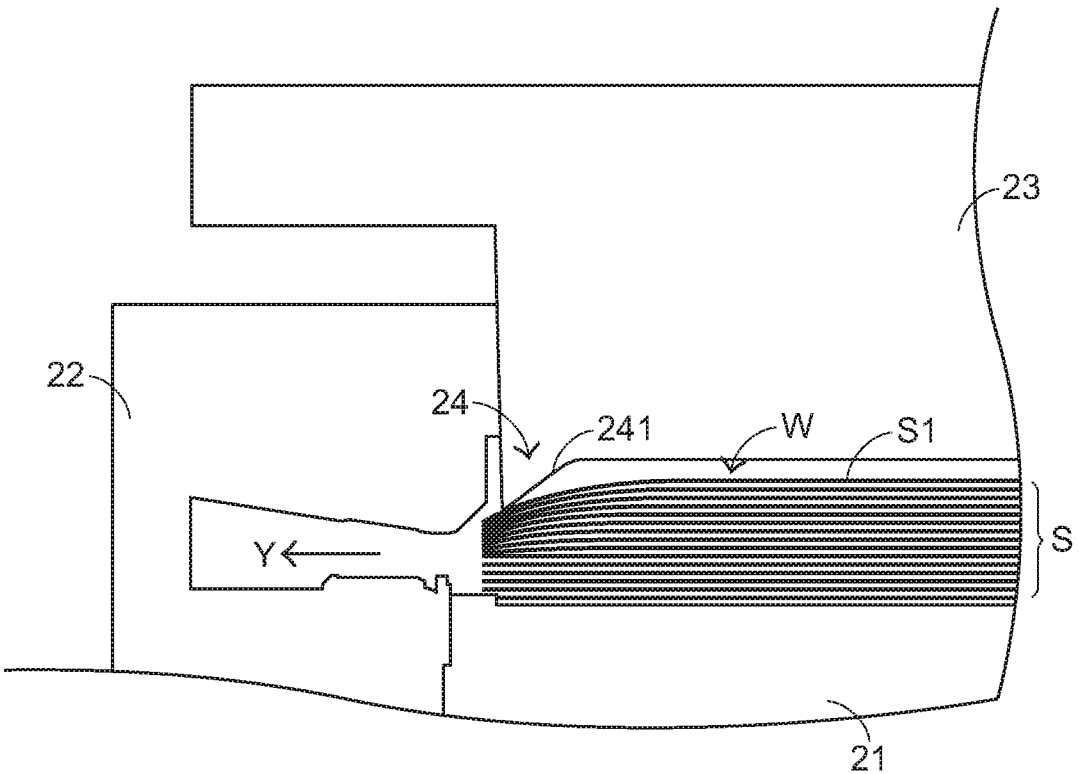
FIG. 6 is a schematic partial rear view illustrating the sheet processing device according to an embodiment of the present invention.

FIG. 6 is a schematic partial rear view illustrating the sheet processing device according to an embodiment of the present invention. Please refer to FIGS. 2 and 6. The stapler 22 is located at a side of the supporting plate 21 for stapling the plural sheets S. For clearly illustrating the relationship between the position-limiting structure 232 of the casing 23, the swinging arm 25 and the first sheet alignment mechanism 26, the stapler 22 as shown in FIG. 2 is indicated by dotted lines.

As shown in FIG. 6, the protrusion structure 24 is disposed on the lower surface 231 of the casing 23. In addition, the protrusion structure 24 is disposed within the sheet conveying channel W, and located beside the stapler 22. In views of cost-effectiveness, the protrusion structure 24 and the casing 23 are made of plastic material, and the protrusion structure 24 is integrally formed with the casing 23. Alternatively, in some embodiments, the protrusion structure 24 and the casing 23 are separate components. Under this circumstance, the protrusion structure 24 is attached on the casing 23 by adhering, fastening, screwing or any other coupling means.

Please refer to FIG. 3 again. The both ends of the shaft 261 of the first sheet alignment mechanism 26 are penetrated through the casing 23. The paddling part 262 is fixed on the shaft 261. As the shaft 261 is rotated, the paddling part 262 is driven to be rotated. The paddling part 262 is used for paddling the topmost sheet S 1. Moreover, the benchmark piece 271 and the pushing piece 272 of the second sheet alignment mechanism 27 are disposed on the casing 23, and located at two opposite sides of the sheet conveying channel W. The benchmark piece 271 and the pushing piece 272 are used for aligning the sheets.

Hereinafter, the operations of the sheet processing device 20 will be illustrated in more details.

Firstly, as shown in FIG. 2, the topmost sheet S1 is ready to be outputted from the outlet 31 of the printing apparatus 30 and introduced into the supporting plate 21 through the sheet conveying channel W in a feeding direction X1. Meanwhile, as shown in FIGS. 2 and 3, a front end of a stapled side F of the topmost sheet S1 is ready to be contacted with the rim 243 of the slant surface 241 of the protrusion structure 24.

Please refer to FIG. 3 again. Since the rim 243 is parallel with the feeding direction X1, the initial contact area between the protrusion structure 24 and the topmost sheet S1 is very small. In such way, when the front end of the stapled side F of the topmost sheet S1 is contacted with the protrusion structure 24, the possibility of resulting in the folded corners of the topmost sheet S1 will be minimized.

Then, the topmost sheet S1 is continuously moved in the feeding direction X1, so that the topmost sheet S1 is contacted with the contact part 242 of the protrusion structure 24. As shown in FIG. 3, the contact part 242 is a planar surface parallel with the feeding direction X1. The contact area between the contact part 242 and the topmost sheet S1 is obviously larger than the contact area between the rim 243 and the topmost sheet S1. Consequently, when the topmost sheet S1 is moved to the contact part 242, the surface of the contact part 242 is contacted with the topmost sheet S1 to flatten the stapled side F of the topmost sheet S1. In such way, the possibility of upturning the stapled side F of the topmost sheet S1 will be minimized.

Figure 4:
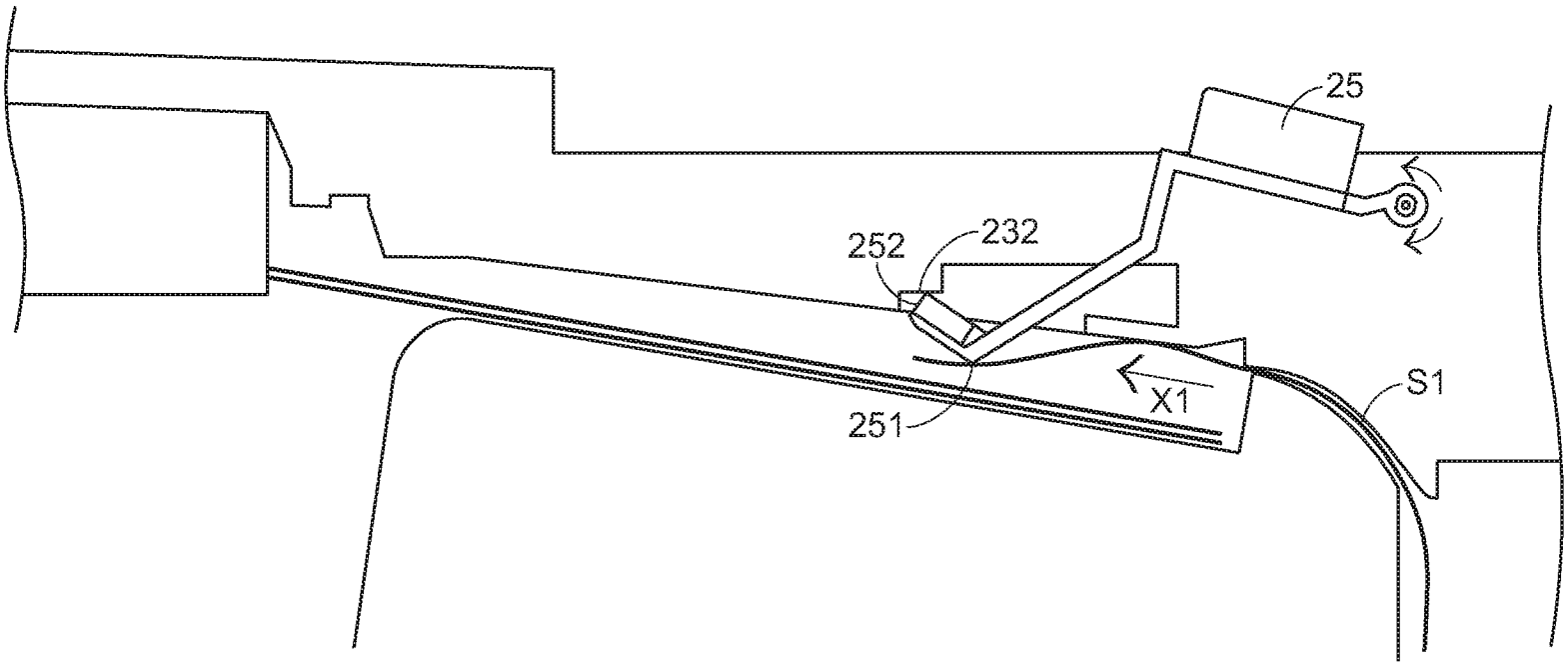
FIG. 4 is a schematic view illustrating the operations of the sheet processing device according to an embodiment of the present invention.

Please refer to FIGS. 3 and 4. FIG. 4 is a schematic view illustrating the operations of the sheet processing device according to an embodiment of the present invention. When the topmost sheet S1 is continuously moved in the feeding direction X1 and moved to the swinging arm 25, the topmost sheet S1 is contacted with the bent part 251 of the swinging arm 25 (see FIG. 3). Meanwhile, the swinging arm 25 is pushed by the topmost sheet S1 which is moved in the feeding direction X1. Consequently, the swinging arm 25 is rotated relative to the casing 23 in a clockwise direction. Under this circumstance, the bent part 251 of the swinging arm 25 is ascended to a higher attitude (see FIG. 4). Then, due to the gravity of the swinging arm 25, the swinging arm 25 is rotated in an anti-clockwise direction, and thus the bent part 251 of the swinging arm 25 is descended down to a lower attitude. Since the topmost sheet S1 is suppressed by the descended bent part 251, the possibility of upturning the non-stapled side N of the topmost sheet S1 (see FIG. 3). In other words, the problem of blocking the sheet conveying channel W will be avoided.

In a preferred embodiment, the casing 23 has a position-limiting structure 232. When the swinging arm 25 is rotated relative to the casing 23 in the clockwise direction by a predetermined angle, the terminal part 252 of the swinging arm 25 is contacted with the position-limiting structure 232 of the casing 23. Consequently, the ascended attitude of the bent part 251 of the swinging arm 25 is limited by the position-limiting structure 232. Under this circumstance, since the rotating angle of the bent part 251 is not too large and the ascended attitude bent part 251 is not too high, the function of flattening the sheet by the bent part 251 can be maintained.

Moreover, as shown in FIG. 3, there is an angle α between the bent part 251 of the swinging arm 25 and the feeding direction X1. In this embodiment, the angle α is larger than 45 degrees and smaller than 90 degrees. Since the angle α is larger than 45 degrees and smaller than 90 degrees, the contact area between the topmost sheet S1 and the bent part 251 can be increased. In other words, the efficacy of flattening the topmost sheet S1 by the bent part 251 is enhanced. It is noted that the preferred range of the angle α is presented herein for purpose of illustration and description only.

Figure 5:
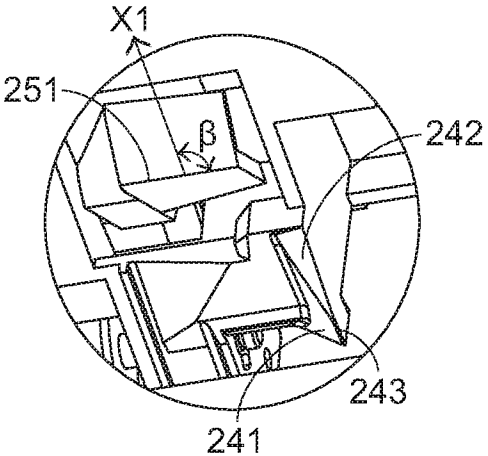
FIG. 5 is a schematic enlarged fragmentary bottom view illustrating the sheet processing device according to another embodiment of the present invention.

FIG. 5 is a schematic enlarged fragmentary bottom view illustrating the sheet processing device according to another embodiment of the present invention. As shown in FIG. 5, there is an angle β between the bent part 251 of the swinging arm 25 and the feeding direction X1. In this embodiment, the angle β is equal to 90 degrees. In other words, the bent part 251 of the swinging arm 25 is perpendicular to the sheet conveying channel W.

After the topmost sheet S1 is completely introduced into the supporting plate 21 and stacked on the top surfaces of the plural sheets S, the sheet processing device 20 starts a sheet-aligning operation. By the sheet-aligning operation, the four edges of the topmost sheet S1 are aligned with the four edges of the stack of sheets S. The sheet-aligning operation performed by the sheet processing device 20 of the present invention is similar to the conventional technology, and is not redundantly described herein.

Please refer to FIG. 3 again. The first sheet alignment mechanism 26 and the second sheet alignment mechanism 27 of the sheet processing device 20 are used for performing the sheet-aligning operation. The first sheet alignment mechanism 26 is disposed on the casing 23, and located downstream of the swinging arm 25. The second sheet alignment mechanism 27 is disposed on the casing 23, and located downstream of the first sheet alignment mechanism 26.

Figure 7:
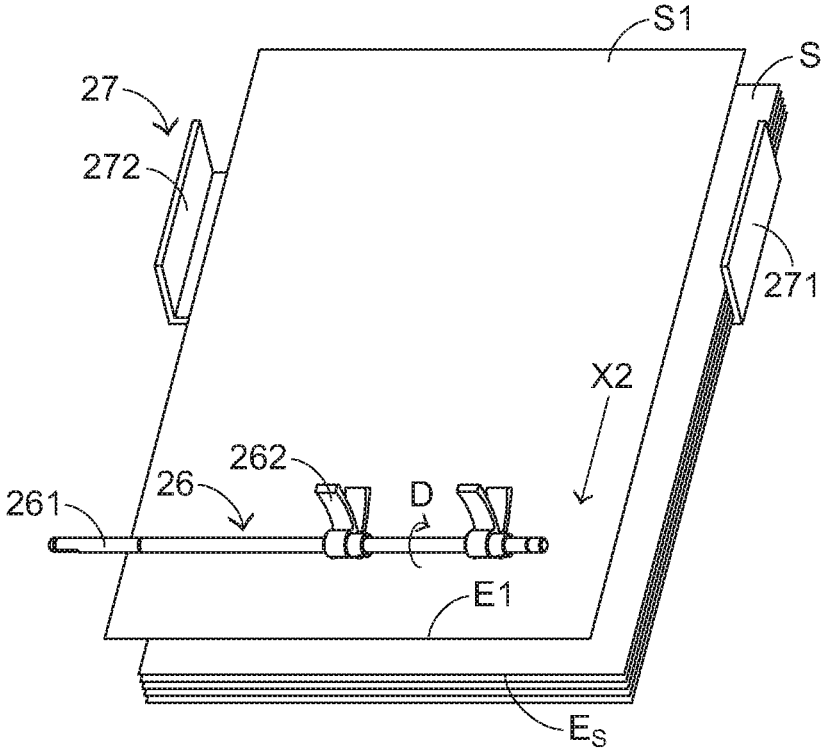
FIGS. 7 and 8 are schematic views illustrating a process of performing the sheet-aligning operation by the sheet processing device of the present invention.
Figure 8:
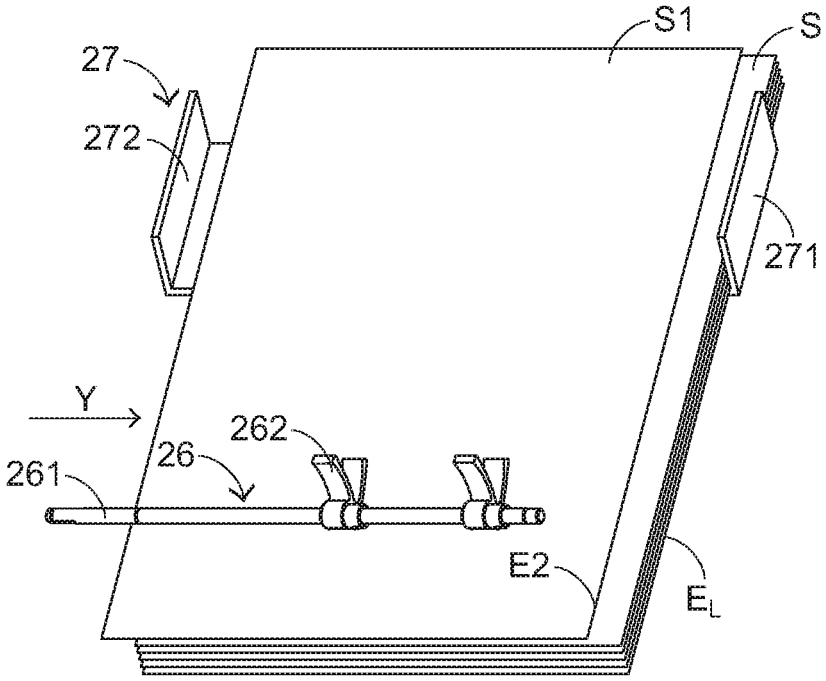

Hereinafter, a process of performing the sheet-aligning operation by the sheet processing device 20 will be illustrated with reference to FIGS. 7 and 8. FIGS. 7 and 8 are schematic views illustrating a process of performing the sheet-aligning operation by the sheet processing device of the present invention.

Firstly, as shown in FIG. 7, the shaft 261 of the first sheet alignment mechanism 26 is rotated in a direction D. Upon rotation of the shaft 261, the paddling part 262 fixed on the shaft 261 is synchronously rotated. In this embodiment, the paddling part 262 comprises one or more arc-shaped rubbery paddles. Since the topmost sheet S1 is pushed by said paddling part 262, the topmost sheet S1 is moved in a reverse feeding direction X2, which is opposed to the feeding direction X1. In such way, a first edge E1 of the topmost sheet S1 is in contact with the alignment side 233 of the casing 23 (see FIG. 3), and thus the first edge E1 of the topmost sheet S1 is aligned with the first edges $E_S$ of the plural sheets S.

Then, the pushing piece 272 of the second sheet alignment mechanism 27 is moved in the direction Y facing the benchmark piece 271. Consequently, a second edge E2 of the topmost sheet S1 is contacted with the benchmark piece 271, and the second edge E2 of the topmost sheet S1 is aligned with the second edges $E_L$ of the plural sheets S. In this embodiment, the first edges $E_S$ of the plural sheets S are the edges of the short sides, and the second edges $E_L$ of the plural sheets S are the edges of the long sides, wherein the length of the first edges $E_S$ is smaller than the length of the second edges $E_L$. Similarly, the length of the first edge E1 of the topmost sheet S1 is smaller than the length of the second edge E2 of the topmost sheet S1.

After the sheet-aligning operation is completed by the second sheet alignment mechanism 27, the topmost sheet S1 is flattened and orderly stacked on the plural sheets S. After the pushing piece 272 is translated in the direction distant from the benchmark piece 271 and moved to the original position, a next sheet is outputted from the outlet 31 of the printing apparatus 30 and served as a new topmost sheet S1. The new topmost sheet S1 is introduced into the supporting plate 21 through the sheet conveying channel W in the feeding direction X1. The above flattening operation and sheet-aligning operation are repeatedly done for each new topmost sheet S1 unit the four edges of the last topmost sheet S1 are aligned with the four edges of the plural sheets S.

After the printing task of the printing apparatus 30 is completed and the plural sheets S to be stapled are aligned with each other by the first sheet alignment mechanism 26 and the second sheet alignment mechanism 27, the sheet processing device 20 will start stapling the plural sheets S. Hereinafter, a process of performing the stapling operation will be illustrated with reference to FIGS. 3 and 6.

As shown in FIG. 3, the benchmark piece 271 and the pushing piece 272 are simultaneously moved in the direction Y to allow the plural sheets S to be introduced into the stapler 22. During the process of introducing the plural sheets S to the stapler 22 (see FIG. 6), the topmost sheet S1 of the plural sheets S is contacted with the slant surface 241 of the protrusion structure 24 in the direction Y and the stapled sides F of the plural sheets S are flattened by the slant surface 241. Consequently, the plural sheets S can be smoothly introduced into the stapler 22 to be stapled. After the plural sheets S are stapled by the stapler 22, the benchmark piece 271 and the pushing piece 272 are simultaneously moved in the direction opposed to the direction Y, and the plural stapled sheets S are placed on the supporting plate 21.

From the above description, the sheet processing device of the present invention comprises a casing and a protrusion structure. The protrusion structure is disposed on the lower surface of the casing. During the process of introducing the topmost sheet into the supporting plate, the topmost sheet is continuously pressed by the contact part and the rim of the protrusion structure. In addition, during the process of stapling the plural sheets, the stapled sides of the plural sheets are flattened by the slant surface of the protrusion structure. In such way, the possibility of upturning the stapled sides of the plural sheets will be minimized, and the formation of the folded corners of the sheets will be avoided. Under this circumstance, the plural sheets are no longer suffered from unrecoverable damage. Consequently, the time cost and the material cost resulted from the sheet damage will be largely reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A sheet processing device for stapling plural sheets fed from a printing apparatus, said sheet processing device comprising:

a supporting plate for supporting said plural sheets to be stapled;

a casing disposed over said supporting plate, wherein a sheet conveying channel is formed between said supporting plate and said casing, and each of said plural sheets is transmitted to said supporting plate through said sheet conveying channel in a first direction;

a stapler located at a side of said supporting plate for stapling said plural sheets received by said supporting plate, wherein said plural sheets are transmitted to said stapler in a second direction different from said first direction;

a protrusion structure extending downward from a lower surface of said casing into said sheet conveying channel, and disposed on a transmission way of said plural sheets to said supporting plate for guiding a front end of each sheet fed from the printing apparatus in said first direction and on the transmission way of said plural sheets to said stapler for flattening corresponding stapled sides of said plural sheets transmitted in said second direction, wherein said protrusion structure has a slant surface so that a transmission path of said plural sheets to said stapler under said protrusion structure is gradually tapered in said second direction; and a swinging arm disposed downstream of said protrusion structure in said first direction, and extending downward into said supporting plate from said casing, wherein said swinging arm is pushed by each sheet fed from the printing apparatus to pivot relative to said casing while depressing the sheet, and said swing arm has a bent part at a free end thereof and is long enough to have the bent part suppress each topmost sheet on said supporting plate after pivoting back for flattening said plural sheets.

2. The sheet processing device according to claim 1, wherein said protrusion structure comprises a rim and a contact part downstream of said rim in said first direction, and a contact area between said rim and a sheet transmitted through said sheet conveying channel is smaller than a contact area between said contact part and the sheet transmitted through said sheet conveying channel.

3. The sheet processing device according to claim 2, wherein said slant surface, said rim and said contact part are formed as parts of said protrusion structure.

4. The sheet processing device according to claim 1, wherein said bent part of said swinging arm is perpendicular to said sheet conveying channel.

5. The sheet processing device according to claim 1, wherein there is an angle between said bent part of said swinging arm and said feeding direction, and said angle is larger than 45 degrees and smaller than 90 degrees.

6. The sheet processing device according to claim 2, wherein said casing further comprises a position-limiting structure for limiting an ascended attitude of said swinging arm.

7. The sheet processing device according to claim 1, wherein said second direction is perpendicular to said first direction.

8. The sheet processing device according to claim 1, wherein said protrusion structure is integrally formed with said casing.

* * * * *